United States Patent [19]

Stevenson

[11] 4,021,516

[45] May 3, 1977

[54] DRAW CLAMP

[76] Inventor: Cleatus G. Stevenson, P.O. Box 436, Ashland, Mont. 59003

[22] Filed: Sept. 20, 1976

[21] Appl. No.: 724,531

Related U.S. Application Data

[63] Continuation-in-part of Ser. No. 572,919, April 29, 1975.

[52] U.S. Cl. ..... 269/41; 269/239

[51] Int. Cl.[2] ..... B25B 1/20

[58] Field of Search ..... 269/41, 42, 53, 228, 269/239, 268, 269

[56] References Cited

UNITED STATES PATENTS

| | | | |
|---|---|---|---|
| 371,349 | 10/1887 | Newell | 269/239 |
| 879,547 | 2/1908 | Holter | 269/53 |

*Primary Examiner*—Al Lawrence Smith
*Assistant Examiner*—Robert C. Watson
*Attorney, Agent, or Firm*—Clarence A. O'Brien; Harvey B. Jacobson

[57] ABSTRACT

A draw clamp for holding together abutting portions of a frame for facilitating joining of the portions to one another has a base member provided with a pair of planar support surfaces extending into the base member toward one another and meeting at substantially a right angle to form a cradle for the frame portions. Pivotally mounted on the base member is a handle which actuates a pair of locking jaws also pivotally mounted on the base member and terminating in double fangs arranged for selectively gripping the frame portions being supported by the cradle. The pivotal mounting for the handle includes an elongated slot in the base member for reception of a pivot pin therethrough. A washer is also provided between the adjacent surfaces of the base member and the handle member. This structure forms a clutch-lock type arrangement. The handle is connected to the locking jaws by a pair of links, each one of which is pivotally connected to the handle and to an arm of an associated locking jaw which extends from a pivot point of the locking jaw in a direction substantially opposite to the direction of an arm which terminates in the associated double fangs. A protrusion on the handle member together with the special shape of the handle forms a portion for engagement by an operator's hand in a non-slip manner.

11 Claims, 5 Drawing Figures

Fig. 1
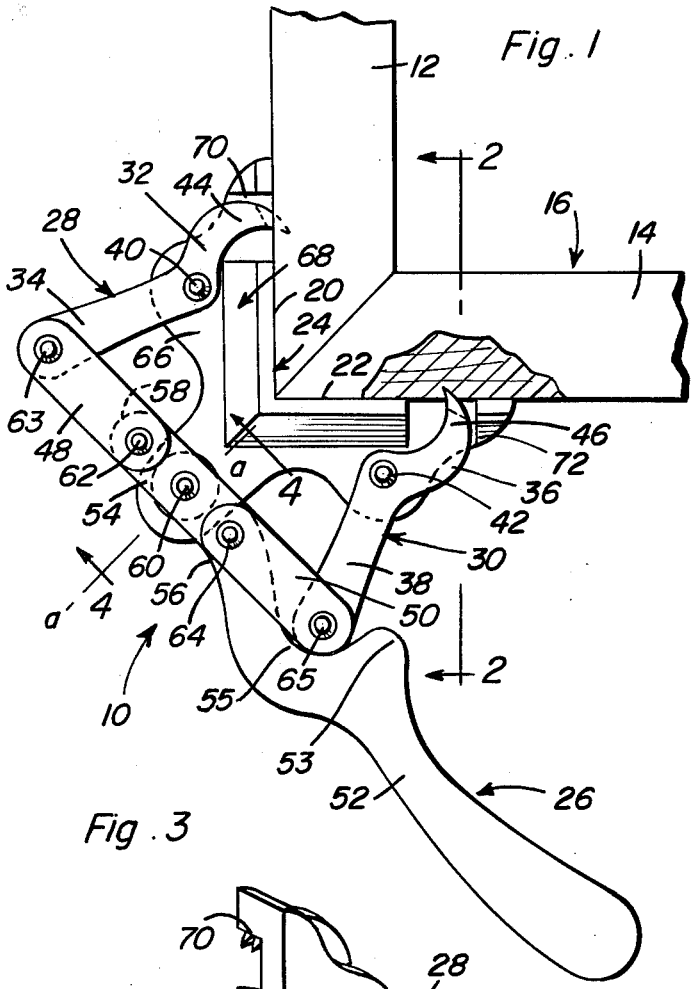
Fig. 2
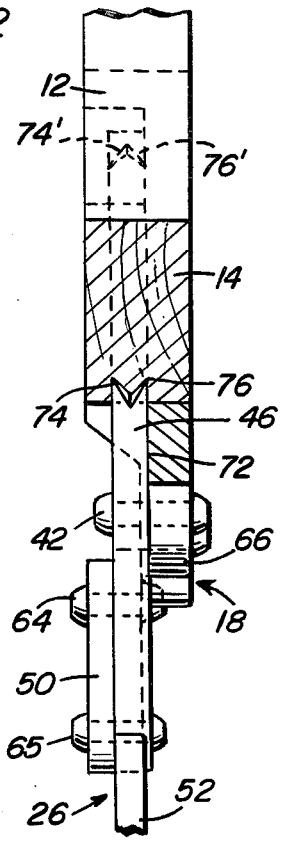
Fig. 3
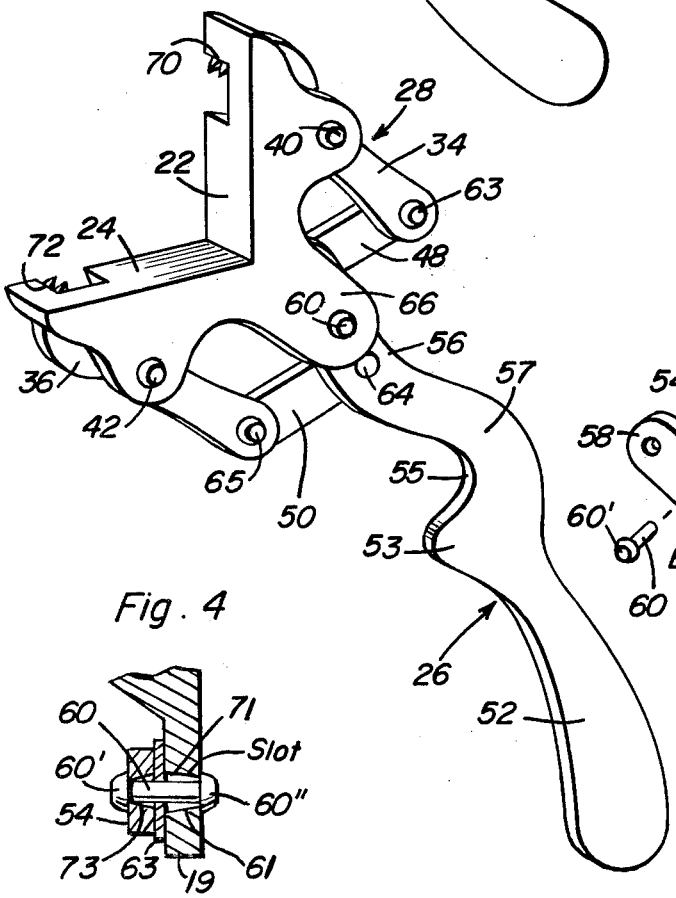
Fig. 5
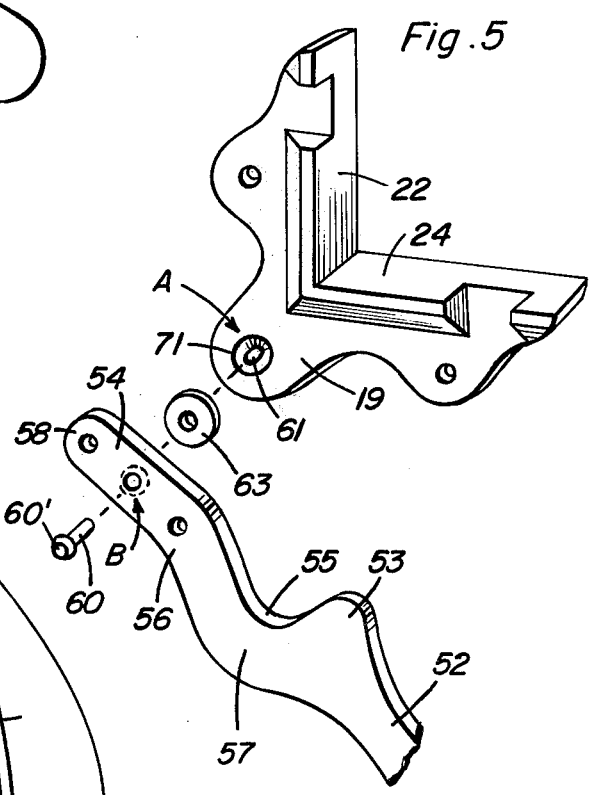
Fig. 4

DRAW CLAMP

This application is a continuation-in-part of application Ser. No. 572,919, filed Apr. 29, 1975 by the same inventor as herein.

BACKGROUND OF THE INVENTION

1. Field of the Invention

This invention relates generally to a clamp, and particularly to a draw clamp for holding together abutting portions of picture frames, and the like and facilitating in joining the frame portions to one another. A clamp clutch-lock pivot mounting is incorporated with this device.

2. Description of the Prior Art

It frequently becomes necessary during the course of woodworking to clamp two or more pieces together while a suitable adhesive which is to connect the pieces is setting. Problems arise, however, when trying to clamp together a pair of pieces which join together to form a mitered or square corner of a picture frame, and the like, since conventional clamps are not suited to clamping together pieces at right angles to one another.

U.S. Pat. No. 371,349, issued Oct. 11, 1887 to G. F. Newell, discloses a miter clamp which is specifically intended for holding together pieces arranged at right angles to one another. This known clamp, however, is somewhat inefficient and imprecise, and accordingly is somewhat limited in its applications.

U.S. Pat. No. 374,264, issued Dec. 6, 1887 to E. L. Miller et al, discloses a miter clamp which is also suited for clamping abutting side rail portions of picture frames and similar structures. This known clamp, however, does not positively engage the frame portions in the manner of the miter clamp of U.S. Pat. No. 371,349, and accordingly is also limited in its application.

U.S. Pat. No. 879,547, issued Feb. 18, 1908 to T. B. Holter, discloses another miter clamp which is also designed for clamping abutting side rail portions of picture frames and the like. However, this clamp does not have the double fangs at the end of each of the locking jaws, nor does it provide for a clutch-lock type structure for the pivotal mounting of the operating handle, as does the device of this invention. Also, the handle is not formed with the slip resistant configuration with protrusion as is the handle of this invention.

SUMMARY OF THE INVENTION

It is an object of the present invention to provide a clamp for holding together abutting portions of picture frames, and the like, which has more efficient and precise construction than known clamps of this kind.

It is another object of the present invention to provide a clamp for holding together abutting portions of a frame wherein the clamp provides greater leverage than known clamps of this kind.

It is still another object of the present invention to provide a clamp for holding together abutting portions of a frame at right angles to one another wherein the clamp includes an actuating linkage affording greater precision, strength, and endurance than known actuating linkages for the same purpose.

Another further object of the present invention is to provide a draw clamp having a better handle formed with a projection extending therefrom to prevent a person's hand from slipping thereon, and better formed to a person's grip.

An additional further object of the present invention is to provide a draw clamp having a clutch-lock type pivotal mounting for the handle to permit an over-center type locking action by the movement of the pivot point of the handle slightly outwardly from the plane of the pivot points of the pivot links for the jaws in order to lock the jaws firmly in the wood of abutting portions of a frame being held by the device.

These and other objects are achieved according to the present invention by providing a draw clamp having: a base member provided with a pair of planar support surfaces extending into the base member toward one another and meeting at substantially right angles to one another to form a cradle for supporting the frame portions to be joined together; a handle pivotally mounted on the base member by a slip clutch-lock type pivotal mounting; a pair of locking jaws pivotally mounted at respective pivots on the base member, and each of the locking jaws including a pair of arms extending away from the associated one of the pivots and terminating in double fangs, with one of the arms of each of the locking jaws being associated with a respective one of the support surfaces provided on the base member for selectively gripping a frame portion being supported by the one of the support surfaces provided on the base member; and a pair of links each pivotally connected to the handle and to the other of the arms of a respective one of the locking jaws and arranged for selectively pivoting the locking jaws relative to the base member and gripping and ungripping the frame portions supported by the cradle formed by the support surfaces of the base member.

Preferably, the handle includes a gripping portion and an attachment portion, with the attachment portion being substantially straight between an end connected to the gripping portion and an end terminating the handle. The attachment portion is pivotally mounted to the base member on a line bisecting the right angle formed by the intersecting support surfaces at the point of meeting of the support surfaces of the base member and substantially midway between the ends of the attached portion. Further, the pair of links are pivotally attached to respective ones of the ends of the attachment portion. The gripping portion has a special slip resistant configuration with a projecting portion to prevent a user's hand from slipping off the hand gripping portion when the device is in use. An accented recess between the protrusion and the attachment portion also permits full actuation of the clutch-lock type pivotal mounting of the device.

The fangs of the locking jaws are advantageously provided with a pair of sharp and slim teeth which facilitate holding of wood, or similar material, securely in place by the locking jaws. The fangs of the locking jaws extend through the support surfaces provided on the base member by means of openings provided in the support surfaces. An important advantage of these double pointed fangs is that when the clamp is used with frame members of hardwood, the double teeth tend to center the frame pieces and prevent twisting and turning of same as the two pieces are clamped tightly together. A single point permits the wood to wobble and a good joint cannot be made.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, front elevational view, partly cut away and in section, showing a draw clamp according to the present invention holding together a pair of picture frame members having mitered corners.

FIG. 2 is a fragmentary, sectional view taken generally along the line 2—2 of FIG. 1.

FIG. 3 is a perspective view looking at the draw clamp according to the present invention from the rear as the clamp is viewed in FIG. 1.

FIG. 4 is a view taken generally along line 4—4 of FIG. 1.

FIG. 5 is a perspective view from the front showing the details of the slip clutch-lock pivotal mount in exploded form.

DESCRIPTION OF THE PREFERRED EMBODIMENT

Referring now more particularly to the drawings, a draw clamp 10 according to the present invention is shown holding together abutting portions 12 and 14 of a, for example, conventional picture frame 16 for facilitating joining of portions 12 and 14 to one another. It will be appreciated, of course, that clamp 10 can be employed wherever two pieces of wood, and the like, are to be joined together at right angles.

Clamp 10 includes a base member 18 provided with a pair of planar support surfaces 20 and 22 extending into base member 18 toward one another and meeting at substantially a right angle with respect to one another to form a cradle 24 for supporting the frame portions 12 and 14 to be joined together. A handle 26 pivotally mounted on base member 18 in a new and novel manner facilitates manipulation of clamp 10 as well as actuates structure to be described below for gripping portions 12 and 14 and retaining same securely in cradle 24.

A pair of locking jaws 28 and 30 are pivotally mounted on base member 18. Each of these jaws 28, 30 includes a pair of arms 32, 34 and 36, 38, respectively, extending away from the associated pivots 40, 42, respectively, with arms 32, 36 terminating in double teeth fangs 44, 46. As perhaps can best be seen in FIG. 1 of the drawings, arms 32 and 36 are associated with a respective one of the support surfaces 20, 22 for selectively gripping a frame portion 12, 14 being supported by the associated one of the support surfaces 20, 22 provided on base member 18.

A pair of links 48 and 50 are each pivotally connected to handle 26 and to the other of the arms 34, 38 of respective ones of locking jaws 28, 30, and are arranged for selectively pivoting locking jaws 28, 30 relative to base member 18 and gripping and ungripping frame portions 12, 14 supported by cradle 24 formed by support surfaces 20, 22 of base member 18.

Handle 26 includes a specially configured gripping portion 52 and an attachment portion 54, with attachment portion 54 being substantially straight between an end 56 connected to gripping portion 52 and an end 58 terminating handle 26 at one end thereof. Attachment portion 54 is pivotally mounted to base member 18 by a pin 60, and a slot 61 arranged on a line *a—a* bisecting the right angle formed at the point of meeting of support surfaces 20, 22 of base member 18. Further, pin 60 is arranged substantially midway between ends 56 and 58 of portion 54. Honed out openings 81, 83 are also provided in 19 and 54, respectively. The opening 81, surrounds the slot 61, and so is basically elliptical in shape, while the opening 73 around the pivot pin aperture is basically circular in shape, as best seen in FIG. 5. The pin 60, the elongated slot 61, the honed openings 81, 83 and the washer 63 which is mounted between the base projection 19 and the attachment portion 54 of the handle 26 provides a new and unique slip clutch-lock pivot arrangement. Links 48 and 50 are pivotally attached to ends 56 and 58 of portion 54 as by pins 62 and 64, with the spaced ends of links 48, 50 being attached to the outermost ends of arms 34, 38, respectively, as by pins 63 and 65, respectively. Pin 60 is retained in place by an enlarged head 60′ at one end, and a swaged or deformed portion 60″ at the other, after assembly.

As can be readily seen from FIG. 1 of the drawings, arms 32, 34 and 36, 38 of locking jaws 28, 30 extend substantially directly away from one another so as to effectively form a pair of rockers.

Gripping portion 52 of handle 26 is advantageously in the illustrated special arcuate shape for facilitating gripping of handle 26 and manipulation of clamp 10. A projection 53 prevents a user's hand from slipping down the handle toward base member 18. Also, the deep recess 55 between the projection 53 and the attachment portion 54 permits the proper swing inwardly of the handle 26 to permit the slip clutch-lock pivot function to be effected.

Base member 18 is advantageously constructed from a plate 66 provided with a beveled flange portion 68 partially forming support surfaces 20 and 22. A pair of openings 70 and 72 are provided in flange portion 68, with opening 70 being associated with support surface 20 and opening 72 being associated with support surface 22. As will be appreciated, openings 70 and 72 permit the double toothed fangs 40 and 46 to pass through support surfaces 20 and 22 and engage frame portions 12 and 14 being joined together.

As can be readily appreciated from the above description and from the drawings, handle 26 of draw clamp 10 is better formed at 52 to a person's grip and has a projecting knob 53 which prevents slippage of a user's hand during manipulation of the clamp 10. Further, the cradle 24 of clamp 10 is constructed in such a manner as to realize a maximum practical length between the openings 70 and 72 and the furthest spaced edge of the plate forming base member 18.

Further, the particular arrangement of linkages and locking jaws assures sufficient leverage to fangs 44 and 46. As can best be seen from FIG. 2 of the drawings, each fang 44, 46 includes a pair of sharp, slim points 74 and 76. These double points or teeth are very important to the proper operation of the device as described below.

OPERATION

Draw clamp 10 operates by handle 26 pushing outwardly the links 48 and 50, which in turn push the arms 34 and 36 of locking jaws 28 and 30 outwardly and cause the double toothed front portion of fangs 44 and 46 to sink into the wood, and the like, of frame forming portions 12 and 14. This is a pushing and locking leverage which is generally of a superior nature.

Further, locking jaws 28 and 30 are pivotally mounted to body member 18 in such a manner that the leverage arm 34, 38 of each of the locking jaws connected to the actuating links 48, 50 is longer than the length of the arms 32 and 36 provided with fangs 44, 46. Thus, adequate force exerted on fangs 44 and 46 for penetration into the material of the parts being joined is assured. In addition, the arrangement of links 48 and 50 on attachment portion 58 eliminates any crossing over of the linkages when the clamp is moved from a gripping position to a non-gripping position, thus permitting more compact construction of the tool.

An important feature of this device is the slip clutch-pivot arrangement of pin 60, slot 61, honed openings 81, 83, and washer 63. As the double teeth 74 and 76 of the fangs 44, 46 bite with a self-centering action into the wood frame pieces 12 and 14, especially when the wood is hardwood, the portion 54 of the handle will be forced outwardly along line *a—a* which bisects elongated slot 61, and the overcenter effect in relation to pivot points 62 and 64 of links 48 and 50 will cause a locking action of the device to take place. Once so locked, pressure on the handle 26 may be released, and yet the draw clamp will continue to clamp pieces 12 and 14 firmly and tightly together. In fact, in order to release the pieces, a user must forceably move lever 26 in the other direction to unlock the action of pin 60, slot 61, openings 81, 83 and washer 63. Also, the deep recess 55 is needed to permit the aforesaid action to take place. Only because of the special shape of portion 57 of the handle can such a deep recess 55 be provided.

Another advantageous feature of the construction of clamp 10 is that the relatively short distance between the pivots 40 and 42 and the fangs 44 and 46 facilitates entry of the fangs into the wood, and the like, by reducing the amount of swing the fangs will make within the associated openings 70 and 72. This gives the double toothed fangs a sharper angle of attack and causes the teeth to center and pull the wood pieces tightly together without tilting, and keep them that way in conjunction with the slip clutch-lock pivot structure.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A draw clamp for holding together abutting portions of a frame being joined to one another, the clamp comprising, in combination:

a. a base member provided with a pair of planar support surfaces extending into the base member toward one another and meeting at substantially a right angle with respect to one another to form a cradle for supporting frame portions to be joined together;

b. a handle pivotally mounted on the base member;

c. a pair of locking jaws pivotally mounted at a pivot on the base member, and each including a pair of arms extending away from the pivot and terminating in a fang, with one of the arms of each of the locking jaws being associated with a respective one of the support surfaces for selectively gripping a frame portion being supported by the one of the support surfaces provided on the base member;

d. a pair of links each pivotally connected to the handle and to the other of the arms of a respective one of the locking jaws and arranged for selectively pivoting the locking jaws relative to the base member and gripping and ungripping the frame portions supported by the cradle formed by the support surfaces of the base member; and e. means associated with the pivotal mounting of the handle for effecting a locking action on same.

2. A structure as defined in claim 1, wherein the handle includes a gripping portion and an attachment portion, with the attachment portion being substantially straight between an end connected to the gripping portion and an end terminating the handle, the attachment portion being pivotally mounted to the base member on a line bisecting the right angle formed at the point of meeting of the support surfaces of the base member and substantially midway between the ends of the attachment portion, and the links being pivotally attached to the ends of the attachment portion.

3. A structure as defined in claim 2, wherein the arms of each of the locking jaws extend substantially directly away from one another.

4. A structure as defined in claim 2, wherein the gripping portion of the handle is arcuate with a protrusion adjacent thereto for facilitating non-slip gripping of the handle.

5. A structure as defined in claim 4, wherein the arms of each of the locking jaws extend substantially directly away from one another.

6. A structure as defined in claim 5, wherein the base member is a plate provided with a flange portion partially forming the support surfaces, a pair of openings provided in the flange portion, one of the openings associated with one of the support surfaces and the other of the openings associated with the other of the support surfaces, the fangs being arranged in the openings for passing through the support surfaces and engaging the frame portions being joined, each of the fangs being formed by a pair of spaced, substantially parallel, coextensive sharp, slim points.

7. A structure as defined in claim 6, wherein the means for effecting the handle locking action includes a pivot pin through the attachment portion of the handle, a slot in the base member in alignment with the bisecting line, and a washer on the pin between the handle and base member.

8. A draw clamp for holding together abutting portions of a frame being joined to one another, the clamp comprising, in combination:

a. a base member provided with a pair of planar support surfaces extending into the base member toward one another and meeting at substantially a right angle with respect to one another to form a cradle for supporting frame portions to be joined together:

b. a handle pivotally mounted on the base member:

c. a pair of locking jaws pivotally mounted at a pivot on the base member, and each including a pair of arms extending away from the pivot and terminating in a fang, with one of the arms of each of the locking jaws being associated with a respective one of the support surfaces for selectively gripping a frame portion being supported by the one of the support surfaces provided on the base member; and d. a pair of links each pivotally connected to the handle and to the other of the arms of a respective one of the locking jaws and arranged for selectively pivoting the locking jaws relative to the base member and gripping and ungripping the frame portions supported by the cradle formed by the support surfaces of the base member, the handle including a gripping portion and an attachment portion being substantially straight between an end connected to the gripping portion and an end terminating the handle, the attachment portion being pivotally mounted to the base member on a line bisecting the right angle formed at the point of meeting of the support surfaces of the base member and substantially midway between the ends of the attachment portion, and the links being pivotally attached to the ends of the attachment portion, the gripping portion of the handle is arcuate for facilitating gripping of the handle, the arms of each of the locking jaws extend substantially directly away from one another, and the base member is a plate provided with a beveled flange portion partially forming the support surfaces, a pair of openings provided in the beveled flange portion, one of the openings associated with one of the support surfaces and the other of the openings associated with the other of the support surfaces, the fangs being arranged in the openings for passing through the support surfaces and engaging the frame portions being joined, each of the fangs being formed by a pair of spaced, substantially parallel, coextensive sharp, slim points.

9. A structure as defined in claim 8, wherein the handle has a projecting knob between the arcuate gripping portion and the attachment portion for preventing slippage of a user's hand during manipulation of the clamp.

10. A structure as defined in claim 9, wherein a slip clutch-lock pivot mounting means is provided for the pivotal mounting of the handle.

11. A structure as defined in claim 10, wherein the slip clutch-lock pivot mounting means includes a pivot pin through the attachment portion of the handle, a slot in the base member in alignment with the bisecting line, and a washer on the pin and between the handle and base member.

* * * * *